US011131147B1

(12) United States Patent
Berger et al.

(10) Patent No.: US 11,131,147 B1
(45) Date of Patent: Sep. 28, 2021

(54) CORE DRILLING APPARATUS AND METHOD FOR CONVERTING BETWEEN A CORE DRILLING ASSEMBLY AND A FULL-DIAMETER DRILLING ASSEMBLY

(71) Applicant: COREALL AS, Algard (NO)

(72) Inventors: Per Erik Berger, Skien (NO); Alf Erik Berle, Radal (NO); Arne Matzel, Hannover (DE)

(73) Assignee: Coreall AS, Ålgård (NO)

( * ) Notice: Subject to any disclaimer, the term of this patent is extended or adjusted under 35 U.S.C. 154(b) by 0 days.

(21) Appl. No.: 16/861,254

(22) Filed: Apr. 29, 2020

(51) Int. Cl.
*E21B 10/02* (2006.01)
*E21B 25/00* (2006.01)

(52) U.S. Cl.
CPC ..... *E21B 10/02* (2013.01); *E21B 25/00* (2013.01)

(58) Field of Classification Search
CPC ..... E21B 10/02; E21B 25/00
See application file for complete search history.

(56) References Cited

U.S. PATENT DOCUMENTS 2,109,903 A * 3/1938 Howard ..... E21B 25/00 175/235
3,548,958 A * 12/1970 Rumble ..... E21B 25/08 175/233
5,351,765 A 10/1994 Ormsby
6,164,389 A * 12/2000 Fanuel ..... E21B 25/08 175/20
7,913,775 B2 3/2011 Jeffryes
8,162,080 B2 4/2012 Castillo
9,567,813 B2 * 2/2017 Fulda ..... E21B 17/1014
10,577,880 B2 3/2020 Connell et al.
2002/0033281 A1 * 3/2002 Aumann ..... E21B 25/005 175/244
2002/0185273 A1 12/2002 Aronstam
2014/0174828 A1 * 6/2014 Muntz ..... E21B 25/02 175/58

(Continued)

FOREIGN PATENT DOCUMENTS

DE 2531466 3/1977
EP 0134586 3/1985
EP 2877676 4/2017

(Continued)

OTHER PUBLICATIONS

ISR dated Jul. 20, 2021 in PCT/EP2021/059462, cited inter alia as a statement of relevance for any non-English refernces cited therein.

*Primary Examiner* — Taras P Bemko
(74) *Attorney, Agent, or Firm* — Christian D. Abel

(57) ABSTRACT

A core drilling apparatus and a method for converting between a core drilling assembly and a full-diameter drilling assembly by means of a lifting device and a coring drill head with closure elements and integrated cutting implements. The lifting device comprises a release mechanism that when activated, releases forces acting on the lifting device, such that when the lifting device is in an upper position when activated, the lifting device lowers an inner tubing thereby pushing the closure elements of the drill head in an open position, and when the lifting device is in a lower position when activated, the lifting device lifts the inner tubing from the closure elements such that the closure elements is in a closed or partly closed position.

16 Claims, 10 Drawing Sheets

(56) References Cited

U.S. PATENT DOCUMENTS

2015/0191985 A1* 7/2015 Berger ..... E21B 47/01
175/24

FOREIGN PATENT DOCUMENTS

| | | |
|---|---|---|
| GB | 2318372 | 4/1998 |
| NO | 316131 | 9/1998 |
| WO | 2020143966 | 7/2020 |

* cited by examiner

CORE DRILLING APPARATUS AND METHOD FOR CONVERTING BETWEEN A CORE DRILLING ASSEMBLY AND A FULL-DIAMETER DRILLING ASSEMBLY

FIELD OF THE INVENTION

The present invention generally relates to extracting core samples from subterranean rock formations, and more specifically to a combined coring and drilling apparatus offering the option to collect a core sample or to drill ahead without collecting additional sample material and doing so without performing a tripping operation.

BACKGROUND

Extracting rock core samples from boreholes has been done since the earliest days of modern hydrocarbon exploration. French engineer Rodolphe Leschot filed the first patent for a diamond-encrusted coring drill head in the United States in 1863, although mainly aimed at the mining industry. The primary objective of extracting core samples from the subsurface is to obtain detailed information about the geological strata, their physical parameters such as mineralogy and porosity, their fluid content, and the succession of strata. Until the invention of wireline logging techniques, coring was the predominant method for acquiring reliable and detailed information about subsurface. For certain types of information required as input data for modern reservoir simulation models, lab analysis of core samples is still considered to provide the most reliable data source.

Current technologies that are designed for cutting and extracting rock core samples from subterranean formations can broadly be divided into two categories. The first category is coring systems for extracting short (a few inches), small-diameter core samples from the borehole wall, i.e. transverse to the borehole axis. The second category is coring systems that collect long (up to hundreds of feet) substantially continuous and potentially larger diameter core samples along the longitudinal borehole axis, using either conventional steel pipe drill string or wireline as the conveyance method.

The second category is the most widely used in the industry, where information about the nature and succession of geological strata in and near a reservoir zone is required. In its fundamental form, such a system will be an assembly comprising a coring head, i.e. a drill bit for cutting or crushing the rock matrix, with a circular opening in the center to allow a cylindrical rock core sample to pass through; an outer tubing with an outer diameter less than the borehole diameter, which conveys the forces required to drill through the rock; and an inner tubing with substantially the same inner diameter as the center opening in the coring head, for collecting and retaining the rock core sample. To prevent a core sample from falling out of the inner tubing, the lower end or "shoe" will be equipped with a serrated ring or some other means to retain the sample, referred to as a "core catcher". The inner tubing is typically mounted on a bearing assembly at the upper end to allow the outer tubing and/or core head to rotate freely around it, whilst the inner tubing remains primarily non-rotating relative to the rock matrix. Hence, the core sample itself will be a substantially continuous cylinder of rock with the same diameter as the innermost rock-cutting segment of the core head, and up to a few hundred feet in length.

The length of the core sample is primarily limited by the length of the inner tubing and by the mechanical strength of the various geological layers being penetrated by the core drilling assembly. If the interval of interest for further analysis of core samples exceeds the length of core barrel that can be run, or if there are multiple zones of interest, this often results in multiple trips in and out of the borehole to extract the core sample and replace the inner tubing or to change between coring and drilling equipment. This is known as tripping and imposes a significant operational cost.

FIG. 1 illustrates a conventional core drilling assembly as known in the industry, comprising a coring drill head 100 with a circular opening in the center to allow the core sample 150 to pass through; an outer tubing 110 for conveying forces to the coring drill head 100; an inner tubing 120 for collecting and retaining the core sample 150; a bearing assembly 130 that allows the outer tubing 110 to rotate freely around the inner tubing 120; and some conveyance arrangement 140, typically a drill pipe. Drilling fluid 160 is pumped from a drilling rig on the surface through the drill pipe 140 and diverted into the inner annulus 161 between the inner tubing 120 and the outer tubing 110. At the coring drill head 100, the drilling fluid 160 is diverted into channels 103 in the coring drill head 100 to exit through ports at the cutting surface of the coring drill head 100, whereupon the return flow of drilling fluid 160 carries rock fragments that have been crushed by the coring drill head 100 back up to surface in the borehole annulus 162 between the outer tubing 110 and the borehole wall. Once the full length of inner tubing 120 has been filled with core sample 150, the inner tubing 120 will need to be extracted from the borehole, either by first extracting the full assembly, or by using wireline or other means to retrieve the inner tubing 120 through the drill string. If it is not desired to take core samples 150 from a specific geological sequence of strata, the core drilling assembly will need to be extracted from the borehole and replaced with a full diameter drilling assembly, i.e. a tripping operation must be performed.

From an operational perspective, it would be more effective to be able to either continuously collect core samples without the constraints imposed by the length of the core barrel for avoiding collapsing or fractured core sample, or to be able to sample only intervals of interest for further analysis on the surface, i.e. drilling with full cross-section of the borehole in those intervals that are not of interest.

Coring systems enabling selective coring or drilling are described in applicant's own patent EP 2877676 B1 and patent application PCT/EP2019/083974. Said publications describe systems for selectively choosing core sample to keep. FIG. 2 illustrates an example described in PCT/EP2019/083974 of a special coring drill head 200 with a closure device 201 that can convert a coring drill head into a full-diameter drill head, and with a lifting device or elevator 230 in the distal end of the assembly for lifting and lowering an inner tubing 220. Like conventional core drilling assemblies known in the industry, the invention also comprises an outer tubing 210; an inner tubing 220 for collecting and retaining a core sample 250; and some means of conveyance 240 connected to the upper end of the core drilling assembly, such as standard drill pipe tubing.

In FIG. 2, the elements of the closure device are shown retracted into the wall of the drill head 200 housing to allow a core sample to pass into the inner tubing 220 for storage. Ports or openings 202 in the wall of the drill head allow debris to exit into the borehole annulus, although these openings are predominantly closed off by the retracted closure device elements when coring. Unlike a conventional system, the bearing assembly 222 for the inner tubing can be connected to or part of a lifting device 230. The lifting device is illustrated in the extended position, so that the end of the inner tubing 221 distal to the bearing assembly 222 is in the immediate proximity of the cutting surface of the coring drill head, and a core sample 250 may pass unhindered into the inner tubing. Within the coring drill head 200, channels 203 direct all or some of the drilling fluid flow out onto the cutting surface of the coring drill head, to allow cooling and removal of rock debris, which is further circulated up through the borehole annulus 262.

This configuration allows the core drilling assembly to be switched/converted from standard coring mode, i.e. collecting core sample material in the inner tubing of the downhole assembly; to full-diameter drilling mode, wherein the center opening in the drill head is closed and rock material that would otherwise constitute a core sample is being disintegrated before entering the inner tubing, thus allowing additional borehole to be drilled without filling up the inner tubing with more material. PCT/EP2019/083974 also discloses the use of a controller device 231 connected to actuators or similar. The controller device 231 receives control commands from an onboard processing unit or from the surface drilling rig for controlling valves and pistons of a lifting device 230. This solution allows multiple activation and deactivation of the lifting device and thus allows switching from coring mode to full-diameter drilling mode multiple times.

The solution described in PCT/EP2019/083974 requires a complex downhole assembly that is wired for at least some transmission of electrical power and data, and some means of generating electrical power downhole or transmitting electrical power from surface. Such a solution is not suited in certain circumstances, e.g. if the focus is to keep costs low, or if the downhole temperature is too high for using downhole electronics.

The present application discloses a core drilling apparatus and methods for activating and/or deactivating the core drilling apparatus between a core drilling assembly and a full-diameter drilling assembly with purely mechanical and/or hydraulic means, i.e. without the use of downhole control electronics and power supply.

SUMMARY OF THE INVENTION

The present invention discloses an apparatus and method for converting a core drilling apparatus between a core drilling assembly and a full-diameter drilling assembly and doing this only with mechanical and/or hydraulic means.

The core drilling apparatus comprises a coring drill head, an outer tubing for conveying forces to the drill head, an inner tubing with an upper end connected to a lifting device and a lower end adapted for receiving a core sample, conveyance arrangement connected to the upper end of the outer tubing, and where the lifting device is adapted to run between an upper and lower position within the outer tubing.

The coring drill head comprises closure elements with integrated cutting implements that when in a closed or partly closed position enable the drilling head to operate with full diameter drilling and with the closure elements in an open position enable the drilling head to operate as a coring drill head by letting rock sample pass into the inner tubing.

The lifting device comprises a release mechanism that when activated, releases forces acting on the lifting device, such that when the lifting device is in an upper position when activated, the lifting device lowers the inner tubing thereby pushing the closure elements in an open position, and when the lifting device is in a lower position when activated, the lifting device lifts the inner tubing from the closure elements such that the closure elements will be in a closed or partly closed position.

In one embodiment, the core drilling apparatus comprises flow channels connecting the lifting device to drilling fluid flow, where the flow channels are opened when the release mechanism is activated thereby letting pressure forces exerted from circulation of drilling fluid in the flow channels act on the lifting device for lifting or lowering it.

In another embodiment, the core drilling apparatus comprises one or more pre-charged hydraulic chambers connected to the lifting device, where fluid flow is released from the hydraulic chamber when the release mechanism is activated, thereby letting pressure forces exerted from the fluid flow act on the lifting device for lifting or lowering it.

In yet another embodiment, the core drilling apparatus comprises one or more compressed springs connected to the lifting device, where mechanical forces are released from the spring when the release mechanism is activated, thereby letting pressure forces exerted from the spring act on the lifting device for lifting or lowering it.

In one embodiment, the release mechanism comprises a ball seat for receiving a ball that when dropped activates the release mechanism.

In another embodiment, the release mechanism comprises a shear pin that when applied mechanical force brakes and activates the release mechanism.

In yet another embodiment, the release mechanism comprises a disc that when applied hydraulic force brakes and activates the release mechanism.

The release mechanism may also comprise an electronic receiving unit adapted to control an electrical valve comprised in the core drilling apparatus when receiving signals from a dropped flowable device.

The invention is also defined by a method for converting a core drilling apparatus between a core drilling assembly and a full-diameter drilling assembly. The core drilling apparatus comprises a coring drill head, an outer tubing for conveying forces to the drill head, an inner tubing with an upper end connected to a lifting device and a lower end adapted to receiving a core sample, conveyance arrangement connected to the upper end of the outer tubing, and where the lifting device is adapted to run between an upper and lower position within the outer tubing.

The method comprises running the core drilling apparatus into a wellbore, and where the coring drill head comprises closure elements with integrated cutting implements that when in a closed or partly closed position enable the drilling head to operate with full diameter drilling and with the closure elements in an open position enable the drilling head to operate as a coring drill head by letting rock sample pass into the inner tubing.

The method further comprises activating a release mechanism comprised in the lifting device thereby releasing forces acting on the lifting device, such that when the lifting device is in an upper position when activated, the lifting device lowers the inner tubing thereby pushing the closure elements in an open position to enable coring mode, and when the lifting device is in a lower position when activated, the lifting device lifts the inner tubing from the closure elements such that the closure elements will be in a closed or partly closed position to enable drilling mode.

According to one embodiment of the method, forces acting on the lifting device when the release mechanism is activated, are released by opening flow channels connecting the lifting device to drilling fluid flow, thereby letting pressure forces exerted from circulation of drilling fluid in the flow channels act on the lifting device for lifting or lowering it.

According to another embodiment of the method, forces acting on the lifting device when the release mechanism is activated, are released by releasing fluid flow from one or more pre-charged hydraulic chambers connected to the lifting device, thereby letting pressure forces exerted from the fluid flow act on the lifting device for lifting or lowering it.

According to yet another embodiment of the method, forces acting on the lifting device when the release mechanism is activated, are released by releasing one or more compressed spring connected to the lifting device, thereby letting mechanical forces exerted from the spring act on the lifting device for lifting or lowering it.

According to one embodiment of the method, the release mechanism is activated by dropping a ball onto a ball seat comprised in the release mechanism.

According to another embodiment of the method, the release mechanism is activated by breaking a disc comprised in the release mechanism.

According to yet another embodiment of the method, the release mechanism is activated by breaking a shear pin comprised in the release mechanism.

The release mechanism may also be activated by letting a flowable device trigger an electronic receiving unit when detecting the flowable device, where the electronic receiving unit is adapted to control an electrical valve comprised in the core drilling apparatus.

All said features of the invention will is described in detail below with examples shown in the figures.

BRIEF DESCRIPTION OF THE DRAWINGS

In the detailed description below, the present invention will be explained with reference to the following figures showing examples of implementations of the inventive features.

The following figure references are used.

Figure 1:
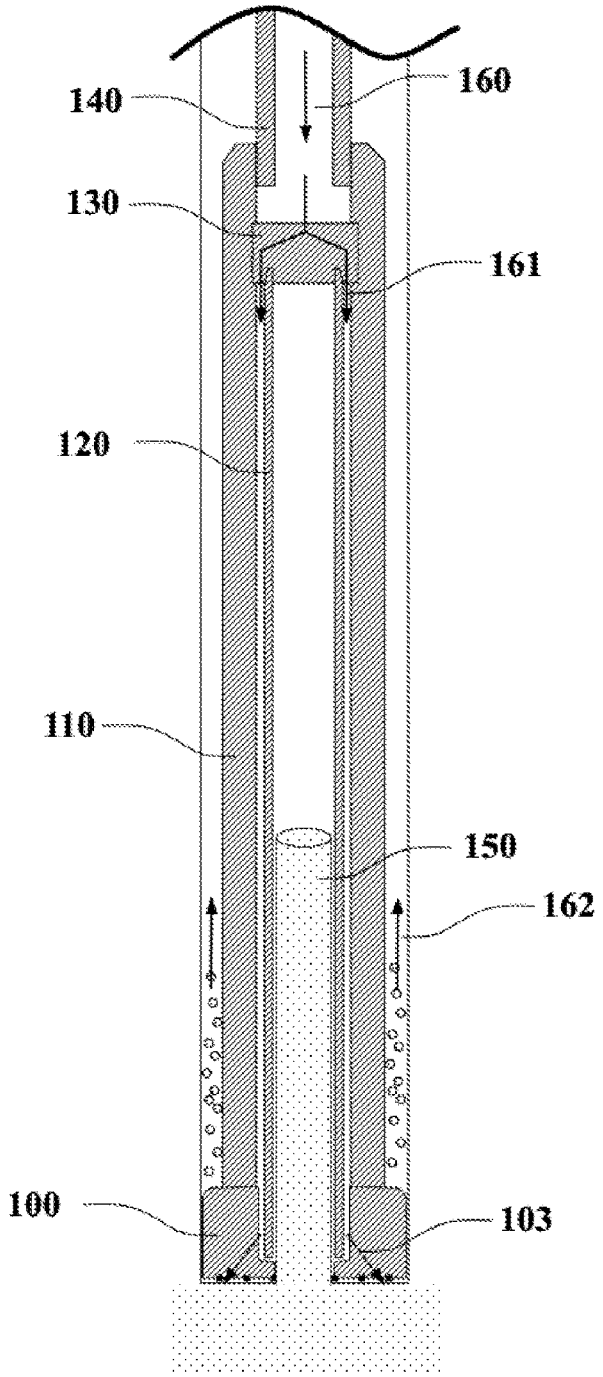
Fig. 1 (prior art)
FIG. 1 shows a conventional core drilling assembly.

100—core drill head
103—channel
110—outer tubing
120—inner tubing
130—bearing assembly
140—conveyance means
150—core sample
160—drilling fluid
161—inner annulus
162—borehole annulus
200—core drill head
201—closure elements
202—drill head opening
203—channels
204—cutting implements
210—outer tubing
220—inner tubing
221—inner tubing end
222—bearing assembly
223—lower bearing assembly
224—upper bearing assembly
225—bearing
226—small drop ball
227—large drop ball
230—lifting device
231—controller device
234—upper chamber
235—lower chamber
238—flow channel
240—conveyance means
250—core sample
260—drilling fluid
261—internal annulus
262—borehole annulus
270—shear pin
271—spring forced shear pin
272—recess
273—spring
275—pre-charged hydraulic chamber
276—valve
277—piston
278—battery
279—electronics unit
280—receiver unit
281—flowable device
282—hydraulic lift system

DETAILED DESCRIPTION OF THE INVENTION

For a detailed explanation of the present invention, reference is made to the following description of the core drilling apparatus and a method for converting the core drilling apparatus between a core drilling assembly and a full-diameter drilling assembly, taken in conjunction with the accompanying drawings showing examples of implementations of the inventive features.

The present invention discloses details of a core drilling apparatus adapted to be used for both drilling and coring without performing a tripping operation as well a method for converting such a core drilling apparatus between coring and drilling modes. The core drilling apparatus can be converted between a core drilling assembly and a full-diameter drilling assembly with purely mechanical and/or hydraulic means, i.e. without the use of downhole complex control electronics and power supply.

The core drilling apparatus comprises a coring drill head, an outer tubing for conveying forces to the drill head, an inner tubing with an upper end connected to a lifting device and a lower end adapted for receiving a core sample. It further comprises conveyance arrangement connected to the upper end of the outer tubing. The lifting device is adapted to run between an upper and lower position within the outer tubing and comprises a release mechanism that when activated, releases forces acting on the lifting device, such that when the lifting device is in an upper position when activated, the lifting device lowers the inner tubing thereby pushing the closure elements in an open position, and when the lifting device is in a lower position when activated, the lifting device lifts the inner tubing from the closure elements such that the closure elements will be in a closed or partly closed position.

The coring drill head comprises closure elements with integrated cutting implements that when in a closed or partly closed position enable the drilling head to operate with full diameter drilling and with the closure elements in an open position enable the drilling head to operate as a coring drill head by letting rock sample pass into the inner tubing.

By closing or substantially closing the center opening of a coring drill head below an inner tubing, rock entering the center opening of the coring drill head will be grinded away. By opening the center opening of a coring drill head below an inner tubing, rock entering the center opening of the coring drill head will enter an inner tubing, thereby making it accessible for further analysis.

The center opening is open or closed by means of closure elements with embedded cutting implements for grinding away drilled rock formations when closed. Grinded debris or rock fragments will be carried to surface with the return flow of drilling fluid via ports in the drill head. The ports are open into the annulus between the drill head and the borehole wall.

Opening and closing the closure elements are done by lifting and lowering the inner tubing. When lowering the inner tubing it will push the closure elements downwards thereby providing an open passage for cored formation material to enter the inner tubing. When lifting the inner tubing it will no longer push down the closure elements and springs or other means connected to the closure elements will push the closure element in a closed position. Details of this mechanism are disclosed in applicant's own patent application PCT/EP2019/083974.

The solution disclosed herein describes further improved features of the apparatus for combined coring and drilling in a wellbore disclosed in PCT/EP2019/083974 and especially details of activation, lifting and lowering mechanisms of the lifting device enabling lifting and lowering of the inner tubing thereby controlling opening and closing of the closure elements.

Figure 2:
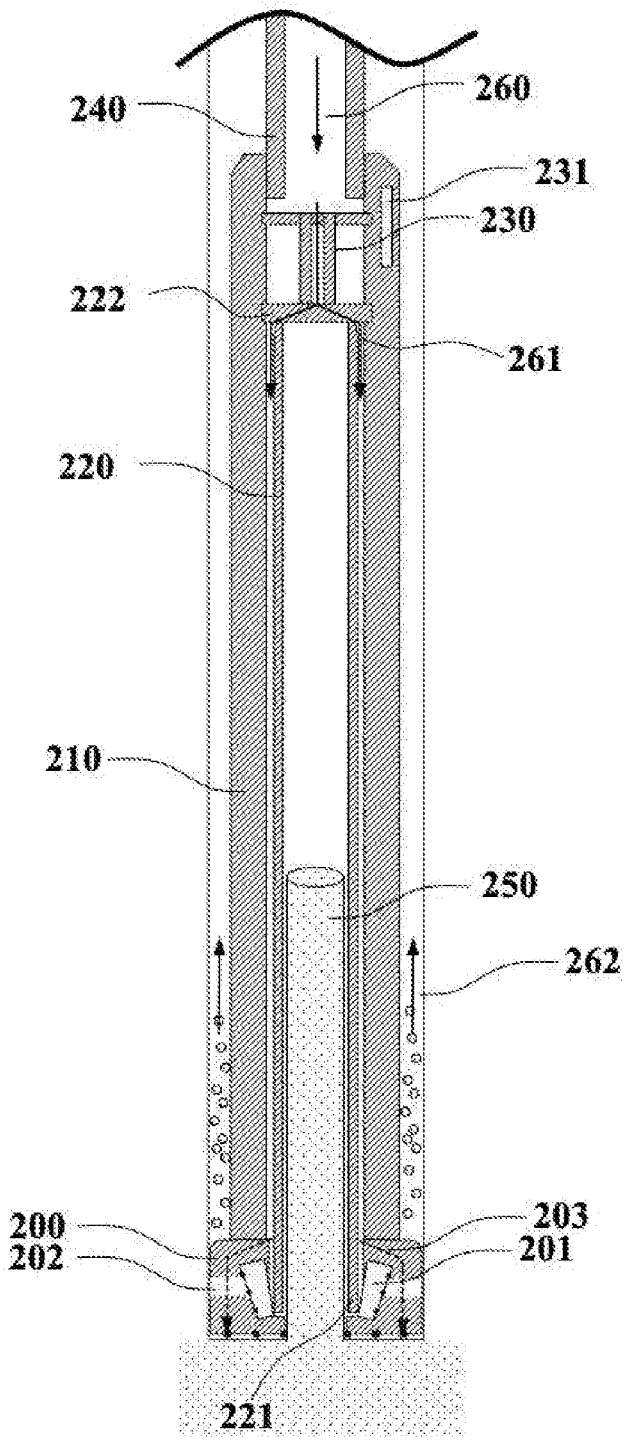
FIG. 2 shows features of a core drilling assembly in coring mode.

In its fundamental form, the present invention comprises the main features in applicant's own patent application PCT/EP2019/083974 described above with reference to FIG. 2, comprising a special coring drill head 200 with a closure device 201 that can convert the coring drill head into a full-diameter drill head, and a lifting device or elevator 230 in the distal end of the assembly for lifting and lowering the inner tubing 220. As for industry state-of-the-art, the invention also comprises an outer tubing 210; an inner tubing 220 for collecting and retaining the core sample 250; and some means of conveyance 240 connected to the upper end of the core drilling assembly, such as standard drill pipe tubing. However, instead of a complex electronic controller device 231 for enabling converting between coring and drilling modes, the present invention provides a non-electrical solution to perform the same functions.

In one configuration, the invention may be set up for a single step operation where the downhole assembly is configured to enable a single transition from drilling mode to coring mode. When running in hole, the inner tubing will be in the uplifted position and the elements of the closure device, comprising cutting implements or teeth, will be extended and engaged below the inner tubing. The tool is then configured for drilling. This tool configuration can then be changed to coring mode on demand.

To convert the core drilling assembly from drilling mode to coring mode and vice versa, a transition from one mode to the other must first be activated. An activation process can be initiated by either dropping a ball inside the drill string, or by other activation means as described below. Once the ball or other activation means is received by the downhole tool, the activation process starts whereby the forces of the actuation mechanism, e.g. being a loaded spring or a charged hydraulic chamber, or any other actuation mechanism, is released. Upon release of the actuation forces, the inner barrel is lowered or pushed downwards, the internal cutter blades of the coring drill head are pushed to the side into its resting position to the sides of the inner tubing, and the inner barrel continues being pushed down into its lowermost position, which will be appropriate for coring. Coring can then commence and proceed until either the inner tubing is filled up with core, or the operator decides to discontinue coring. The core drilling apparatus and core may subsequently be pulled out of the hole and laid down on surface.

Similarly, the invention may be used in the opposite application: In this case, the device is also set for a single step operation but configured to enable a transition from coring mode to drilling mode. When running in hole, the inner tubing will be in the lowered position and the internal cutters of the coring drill head will be retracted in its resting position in the wall of the tool behind the inner tubing, i.e. the tool is configured for coring. This tool configuration can then be changed to drilling mode on demand. This is done by initiating the activation process by either dropping a ball inside the drill string, or any other activation means as previously described. Once the ball or any other appropriate activation means is received by the downhole tool, the activation process starts whereby the forces of the actuation mechanism, such as a loaded spring or a charged hydraulic chamber, or any other actuation mechanism as later described, is released. Upon release of the actuation forces, the inner tubing is retracted or lifted upwards, thus releasing the internal cutter blades of the device in or near the coring drill head from its retracted position, allowing these to move into the core path below the inner tubing and closing off the central opening of the coring drill head. With the cutter blades in closed position, the downhole assembly will be configured for full-diameter drilling. Drilling can then commence and continue as appropriate, without having to perform a roundtrip to surface to change from a coring assembly to drilling assembly.

In another embodiment, the invention may be configured for a dual-step operation: The core drilling apparatus would be run into the borehole configured for full-diameter drilling, then at the appropriate time be activated a first time to perform a transition from drilling to coring, then a second time to perform a transition from coring back to drilling. Compared to a conventional drilling-and-coring wellbore operation, two complete round-trips to change downhole equipment will be eliminated: The first operation to change from a drilling assembly to a coring assembly, and the second operation to change from a coring assembly back to a drilling assembly. In comparison to standard wellbore operation, the first could be associated with changing from drilling to coring once the core point is reached. The second could be associated with changing from coring to drilling once coring is complete.

When running in hole in drilling mode, the inner tubing will be in the uplifted position and the closure elements of the coring drill head will be extended and engaged below the inner tubing. The tool is then configured for drilling and can be changed to coring mode on demand. This is done by initiating a first activation process by either dropping a ball inside the drill string, or any other activation means as later described. Once the ball or any other appropriate activation means is received by the downhole tool, the first activation process starts whereby the forces of the actuation mechanism, being a loaded spring or a charged hydraulic chamber, or any other actuation mechanism as later described, is released. Upon release of the actuation forces, the inner barrel is lowered or pushed downwards, the closure elements of the coring drill head are pushed to the side into their resting position behind the inner tubing. The inner tubing continues to be lowered or pushed down into its lowermost position which will be appropriate for coring. Coring can then commence and proceed until either the inner tubing is filled up with core, or the coring process is discontinued for any reason. Instead of pulling the core drilling assembly out of the borehole out of the hole to lay down the core and change from coring assembly to drilling assembly, the second activation step is activated. This is done by either dropping a ball inside the drill string, or any other second activation means as later described. Once the ball or other activation means is received by the downhole tool, the second activation process starts whereby the forces of the actuation mechanism, is released. Upon release of the actuation forces, the inner barrel is lifted or pushed upwards, the closure elements of the coring drill head are released from its retracted position and allowed to move into the core path below the inner tubing, which will be appropriate for drilling. Drilling can then re-commence as appropriate, without having to perform a roundtrip to surface to change from coring assembly to drilling assembly. Once drilling is complete, the convertible core drilling apparatus and collected core sample may be pulled out of the borehole and laid down on surface.

Similarly, the invention may be configured for a dual-step operation in the reverse order: The convertible core drilling assembly would be run into the borehole configured for coring, then activated a first time to perform a transition from coring to drilling, subsequently a second time to perform a transition from drilling back to coring. When run into the borehole, the inner tubing will be in the lowered position and the closure elements of the coring drill head will be retracted in its resting position in the wall of the tool behind the inner tubing. The tool is then configured for coring. Once cutting of the first core interval is complete, the tool configuration can then be changed to drilling mode on demand. This is done by initiating a first activation process by either dropping a ball inside the drill string, or any other activation means as later described. Once the ball or any other activation means as appropriate is received by the downhole tool, the first activation process starts whereby the forces of the actuation mechanism, being a loaded spring or a charged hydraulic chamber, or any other actuation mechanism as later described, is released. Upon release of the actuation forces, the inner barrel is lifted or pushed upwards, the closure elements of the coring drill head are released from its retracted position and allowed to move into the core path below the inner tubing, transitioning the apparatus to drilling mode. Drilling can then commence as appropriate. When a second core sampling point is reached, the apparatus can be converted from a drilling configuration to a coring configuration on demand. This is done by initiating a second activation process, either by dropping a second ball inside the drill string, or by any other activation means. Once the ball or other activation means is received by the downhole tool, the second activation process starts whereby the forces of the actuation mechanism, being a loaded spring or a charged hydraulic chamber, or any other actuation mechanism, is released. Upon release of the actuation forces, the inner barrel is lowered or pushed downwards, the closure elements of the coring drill head are pushed to the side into its resting position behind the inner tubing, and the inner tubing continues being pushed down into its lowermost position. The apparatus will then be configured for core sampling, and coring of the second interval may commence and proceed until either the entire inner tubing is filled up with core, or coring is discontinued for any other reason.

As can be inferred, it is possible to add functionality to the invention by including additional activation mechanisms. This could either be by dropping balls of incremental size, corresponding to ball seats of the same incremental size in the receiver unit of the activation mechanism, or by other means that could work in incremental steps, or any combination of methods. In this manner, it would be possible to design a system whereby the lifting device is activated and deactivated multiple times.

The following provides descriptions of various alternatives for activating the lifting/lowering mechanism of the core drilling apparatus. The fundamental idea is based on patent application PCT/EP2019/083974, wherein electrical power is used to shift valves that open for drilling fluid flow to pressurize pistons that are used to lift or lower the inner tubing. In one configuration, the drilling fluid flow in the conveying drill string is utilized to place hydraulic pressure on a piston to lift the entire inner tubing, thus opening the space below the inner tubing for the closure elements of the special coring drill head to move into the core path and activate the apparatus for drilling mode. The reverse operation is also disclosed, again utilizing electrical current to shift a valve that opens for the drilling fluid flow to put pressure on a piston in the opposite direction, hence pushing the inner tubing downwards to force the cutter elements at the lower end of the inner tubing into its recess positions and continue lowering the inner tubing until it is in position for coring. The described method is based on having both a means for two-way communication between the surface control unit and the downhole equipment, and on having electrical power generation and electronic processing means in the downhole tool. The present invention, on the other hand, does generally not utilize such means for communication, electrical power generation, or electronics processing. One exception to this is a description of a apparatus using on-board power, such as a battery, that is brought with the tool when running it in hole, and electronics processing to operate the hydraulic lift, but without the previously patented two-way communication to surface means, such as described in patent application PCT/EP2019/083974.

The present invention comprises an activation mechanism to convert the core drilling apparatus from a configuration for coring operations to a configuration for drilling operations, or to convert from a configuration for drilling operations to a configuration for coring operations, primarily without the use of electronics. However, as previously stated, in one specific configuration, as described in the final part of the patent description, the invention is described as using an electronic controller mechanism operated with a downhole electrical power source such as a battery. In one embodiment, the core drilling apparatus is set up for single execution, wherein the apparatus can be converted from one mode of operation to the other mode of operation once. The described activation methods for the lifting mechanism can be combined in an apparatus both for lifting and for lowering the inner tubing, or any combination thereof.

Various means of initiating an activation sequence are described below. One traditional method to change the state of downhole equipment is by dropping a steel ball or similar from the surface. The ball will be placed inside the drill string and pumped downhole until it lands in a ball seat in the downhole equipment. The method of dropping a ball from surface is well known in the art and is commonly used to initiate the coring process in conventional core drilling operations, i.e. to divert the drilling fluid flow from inside the inner tubing of the core drilling equipment to the annular between the inner and outer tubing of the core drilling equipment. The principle is to have full opening through the inner tubing when running the core drilling apparatus in hole, which will allow drilling fluid to be pumped through the drill pipe and core drilling apparatus to clean the inner tubing prior to commencing core drilling. Subsequently, a ball is dropped either from surface or released from within the downhole equipment above the inner tubing to enter the flow path. Upon landing in a ball-seat, the ball will prevent drilling fluid flow through the inner tubing, forcing instead the drilling fluid into the annular between the inner and outer tubing, thus entering a mode of operation where coring can be engaged and the core travel into the inner tubing without the drilling fluid providing resistance and potentially washing the core sample away.

A similar method can be used to activate the lifting device of the present invention. A ball can be dropped from surface to land at a ball-seat above the inner tubing. This will then alter the drilling fluid flow through the tool, diverting all or parts of the fluid flow. The diverted portion of the drilling fluid flow will pass through a flow channel that may be directed to a piston, thus placing a hydraulic force on said piston. The hydraulic force is then used to lift the inner tubing. Principally, the energy behind this hydraulic force is the pressure differential between the inside and the outside of the outer tubing at the location of the activation mechanism. By lifting the inner tubing, the closure elements and cutting implements of the apparatus will then be allowed to enter the space below the inner tubing and thus shift the configuration of the apparatus from coring mode with the closure elements retracted, to drilling mode with the cutter elements activated. This describes a single activation of the apparatus from coring to drilling mode of operation.

It can be inferred that the same method of activation may be used to achieve the opposite operation. Upon dropping a ball from surface to land at a ball seat above the inner tubing, the drilling fluid flow through the equipment will be diverted. The diverted portion of the drilling fluid flow will pass through a flow channel that may be directed to a piston, thus putting a hydraulic force on said piston and using this hydraulic force to push down or lower the inner tubing. This method of activation will then, by lowering the inner tubing, force the closure elements of the apparatus into their recess spaces behind the inner tubing. The inner tubing will then be lowered further into its lowermost position, thus shifting the configuration of the core drilling apparatus from drilling mode with the cutter elements activated, to coring mode with the cutter elements retracted. This describes a single activation of the apparatus from drilling to coring mode.

Alternative methods of initiating the activation mechanism may be used. One such method could be to use mechanical force applied from the surface, for instance by halting the drilling or coring operation by stopping the rotation of the drill string and resting the coring drill head at the bottom of the hole, then subsequently applying excessive weight from surface by lowering the drill string and compressing a device such as a shear pin, whereupon the shearing of the pin releases the forces that will trigger the activation process. Yet another method of initiating the activation process could be to increase the pump rate of the drilling fluid to where it flows through the tool at an increasingly higher rate until a downhole disc breaks, thus releasing the forces that will trigger the activation mechanism of the apparatus.

Another alternative method of activating the hydraulic lift is to use a semi-autonomous electrical activation method. This method will not rely on a full downhole instrumentation package with power supply means, electronic processing means and two-way communication to surface means, such as described in patent application PCT/EP2019/083974. This alternative electrical device could use either a turbine/generator assembly, a battery or other means for providing electrical power. It could further include a receiver means for receiving an activation command from surface, such receiver means could either be a device capable of receiving information carried by a flowable device that is dropped through the drill string at surface, or measuring variations in drill string rpm, or measuring variations in applied downhole weight, or variations in mud flow rate, or any other activation command means, or any combination thereof. The activation tool could further include an electronic processing means for controlling the apparatus and initiating the appropriate action, and furthermore include an electrical operated valve means for opening and closing flow conduits for releasing hydraulic force from a hydraulic chamber, or diverting the mud flow to direct hydraulic force at a piston for either lifting or lowering the coring inner tubing, or any other means of opening or closing hydraulic conduits to initiate lifting or lowering of the inner tubing assembly.

A more detailed description of the concept of utilizing a flowable device as a means of carrying information and commands from the surface to a downhole tool, or from a downhole tool to the surface, is found in patent US 20020185273 A1 Method of Utilizing Flowable Devices in Wellbores by Aronstam et. al.

Alternative methods also exist for either lifting or lowering the inner tubing. One such alternative is to use a spring. When running the core drilling apparatus in hole, said spring would be compressed. Upon dropping the ball and receiving this at the ball-seat, the diverted flow of drilling fluid may be used to break a disc or a shear pin or by other means release the said spring. In one embodiment, the released force of the spring will lift the inner tubing and transitioning the apparatus from coring mode to drilling mode as previously described. With a different configuration, the spring will upon release apply a force that will lower the inner tubing, thus transitioning the apparatus from drilling mode to coring mode as previously described.

In yet another embodiment, lifting or lowering the inner tubing may be achieved by utilizing a hydraulic chamber. Prior to running the core drilling apparatus into the borehole, this chamber is pre-charged with compressed fluid. Upon dropping the ball and receiving this at the ball-seat, the diverted flow of drilling fluid may be used to break a disc or a shear pin or by other means release the hydraulic forces within the pre-charged chamber. In one configuration, said hydraulic force will upon release be directed to a piston that will lift the inner tubing, transitioning the apparatus from coring mode to drilling mode as previously described. In another configuration, the hydraulic force will upon release be directed to a piston that will push down or lower the inner tubing, transitioning the apparatus from drilling mode to coring mode as previously described.

The descriptions above of alternative methods for activating a lifting device for the inner tubing are all describing single activations where the core drilling apparatus is either converted from coring mode to drilling mode or converted from drilling mode to coring mode. These methods can be combined in a way that enables to apparatus to be configured for a dual operation, for instance to change first from coring mode to drilling mode, then back to coring mode again, and vice versa. Said methods of activation can be further combined to achieve multiple modes of operation, thus converting the apparatus multiple times from coring mode to drilling mode, and vice versa.

A prerequisite for enabling the core drilling apparatus to convert between coring mode and drilling mode twice or multiple times, is that the initiation of the activation process can be done more than once. One such method would be to drop steel balls of increasing size, corresponding to ball-seats of equally increasing sizes, each new and larger ball thus triggering a new and specific sequence of events. Similarly, the method of applying increasing weight from surface may be used to break shear pins of increasing strength. The method of using increased amounts of drilling fluid flow pumped from surface may also be used in incremental steps to break discs of increasing strength. Also, the method of an electrical activation mechanism which is semi-automatic in its nature, and is activated by a command from surface by pumping drill fluid in a specific pre-determined sequence, or rotating the drill string in a specific pre-determined sequence, or dropping a flowable device that carries the message or command to a downhole receiver unit within the core drilling apparatus, or any combination of the afore mentioned activation methods. Finally, the above methods, or any other method of downhole activation know in the art, may be combined to enable multiple processes of initiating a specific activation process.

In the following, various combinations of activation mechanisms and sources for providing a lifting force for a lifting device are outlined. One embodiment of the invention is to utilize a combination of diverted drilling fluid flow to both lift and lower the inner tubing. Irrespective of the inner tubing being lifted or lowered, the method is the same, and is previously described. In one application the activation is first used to convert the apparatus from coring mode to drilling mode, where the diverted drilling fluid flow is used to lift the inner tubing. When drilling fluid is pumped down from surface, it will provide a constant pressure on the hydraulic piston and prevent the inner tubing from sliding down by the force of gravity. If for any reason the circulation of drilling fluid from the surface installation is stopped, the pressure on the hydraulic piston will cease. Hence, unless the inner tubing is locked in place, it may subsequently slide down and force the closure elements in the coring drill head back into their retracted position, thus unintentionally converting the apparatus back to coring mode.

Consequently, a mechanism is required that will prevent the inner tubing from sliding down unintentionally when the hydraulic pressure is removed. This may be achieved at the lower end of the inner tubing by interlocking the closure elements of the coring drill head and thus preventing the inner tubing from falling down. Alternatively, the same result may be achieved by having one or more shear pins or other similar devices that once the lifting process has reached its highest position move into a recess and lock the inner barrel lift in place. Either way, the strength of the closure element lock or the shear pin must be sufficient to hold the weight of the inner tubing suspended. As previously described, the diverted drilling fluid flow system may subsequently be used to lower the inner tubing. It is then essential that the strength of the interlocking of the cutter elements, or the strength of the shear pins can be overcome by the force the hydraulic pressure when applied in the opposite direction.

It should be noted that drilling may be performed without a mechanism to lock the inner tubing in its lifted position: While drilling, rock matrix immediately below the closure elements in the coring drill head will prevent the cutter elements from retracting. In effect, the bottom of the hole will act as the locking mechanism preventing the inner tubing from being lowered. However, once the entire drill string is lifted off the bottom of the wellbore, this will open a space between the closure elements and the rock below, and unless the cutter elements are interlocked, or the inner tubing is locked at the activation mechanism, the inner tubing may then move downwards.

In another embodiment, the activation mechanism is using a spring to either lift or lower the inner tubing. The spring, or springs, may be pre-compressed and in an energized state while being installed in the apparatus and run in hole. As previously described, a release mechanism may upon activation allow the spring to expand, and by so doing either lift or lower the inner tubing, depending on its position. When a spring mechanism is used, this may or may not be combined by another mechanism to lock the spring in place in its extended position. A spring will retain parts of its potential energy unless it can fully expand. The spring may be designed to release its energy from an initial fully compressed state to lift the inner tubing thereby enabling a transition from coring mode to drilling mode, then to subsequently remain at a semi-compressed state while drilling, thus retaining enough force to essentially prevent the inner tubing from traveling downwards by force of gravity when the drill string is lifted from the bottom of the hole.

In yet another embodiment, the activation mechanism is designed to use a combination of a spring and the drilling fluid flow. This combination can be designed in two ways: In the first embodiment, the drilling fluid flow method is used to lift the inner tubing, as previously described to convert the core drilling apparatus from coring mode to drilling mode. This is then combined with a spring to lower the inner tubing and perform a transition back to coring mode. In an alternative second embodiment, the opposite activation methods are used. The spring method is used to lift the inner tubing, whereas the drilling fluid flow method is utilized to lower the inner tubing.

Further to the above description of using a spring in combination with the drilling fluid flow method to lift or lower the inner tubing, a spring can also be installed in a non-compressed state with no pre-charged energy. The spring activation mechanism would then be initially energized by utilizing either the drilling fluid flow activation method or the hydraulic chamber activation method. In one embodiment, a drilling fluid flow mechanism is used to first lift the tubing to convert from coring to drilling modes. Simultaneously, while the inner tubing is being lifted, the spring mechanism is being compressed. When the inner core string has been lifted to its uppermost position, a shear pin or other locking mechanism is activated to prevent the inner core string from being lowered by the force of gravity, thus at the same time preventing the now compressed spring from being released. The hydraulic chamber activation mechanism will principally function in an identical way and both lift the inner tubing and simultaneously compress the spring mechanism. Some alternative options for utilizing a hydraulic chamber mechanism are described in more detail later.

Whichever of these embodiments is used, the convertible core drilling apparatus may typically first be used in coring mode. Upon initiating the first activation sequence, the drilling fluid flow or the hydraulic chamber activation lifts the inner tubing and the apparatus is now transitioned to drilling mode. Upon initiating the second activation sequence, the release of the compressional forces of the spring will lower the inner tubing and subsequently perform a transition back to the coring mode. As previously described, additional activation sequences may be included in the apparatus to add the capability of repeating the step of using the drilling fluid flow to lift the inner tubing and compress then spring, followed by a potential for yet again releasing the compressional forces of the spring and lower the tubing. In principal, the first and second activation sequence may be repeated multiple times. When using the drilling fluid flow activation mechanism in combination with a spring, this may in principal be repeated without limitation. When using the hydraulic chamber to lift the inner tubing, the number of times this step can be repeated is limited to the number of hydraulic chambers that are installed in the core drilling apparatus prior to running in hole, as these hydraulic chambers are pre-energized prior to installation, as opposed to the drilling fluid flow mechanism which is energized downhole by the drilling fluid flow. However, if the downhole electric activation mechanism is used, there are no limitation to the number of times this can be operated.

In another embodiment, a reverse configuration is used. In this embodiment, the convertible core drilling apparatus is run in the wellbore in drilling mode. Upon initiating the first activation sequence, the drilling fluid flow or the hydraulic chamber activation is used to lower the inner tubing and the apparatus is thus transitioned to coring mode. Upon initiating the second activation sequence, the release of the compressional forces of the spring will lift the inner tubing and perform a transition back to drilling mode. Again, the potential for multiple activation and deactivation sequences can be inferred.

As previously mentioned, one alternative embodiment is to utilize a hydraulic chamber to provide lifting force, as opposed to utilize the differential pressure potential inherent in the circulation of drilling fluid. The hydraulic chamber will be pre-charged with a compressed hydraulic fluid, liquid or gas to a pre-set pressure.

A significant difference between the use of a hydraulic chamber and the drilling fluid flow, is that the hydraulic chamber may only be activated and released once, while the drilling fluid may be utilized multiple times with the appropriate apparatus. In consequence, to allow the invention to activate and deactivate multiple times by using pre-charged hydraulic chambers, multiple hydraulic chambers are required where an equivalent number of hydraulic chambers will be required in the apparatus to match the number of activation and deactivations intended. A core drilling apparatus containing a plurality of hydraulic chambers for multiple activations of either lifting or lowering the inner tubing is then implemented. Small pressure vessels may be used as hydraulic chambers, filled with gas or liquid, and pressurized to the appropriate pre-set pressure. Several pressure vessels may be housed in a revolving unit with a plurality of hydraulic chambers. In one embodiment, upon activation of the first hydraulic chamber, the revolving unit containing the one or more pressure vessels is rotated to where the first pressure vessel in the first hydraulic chamber is aligned with the fluid flow channel to the piston, and the pressure subsequently released and the inner tubing either lifted or lowered as appropriate. In another embodiment, the hydraulic chambers containing the pressure vessel is not revolving, but instead a manifold unit at the mouth of the hydraulic chambers is revolving to align the flow channel between piston and the relevant hydraulic chamber as appropriate to subsequently release the pressure within the relevant pressure vessel and apply said pressure to the piston to either lift or lower the inner tubing.

In one embodiment, hydraulic chambers are used for both lifting the inner tubing and for lowering the inner tubing. Irrespective of the inner tubing being lifted or lowered, the method is the same, i.e. the energy potential in a pre-charged hydraulic chamber is used to apply hydraulic pressure on a piston that will lift or lower the inner tubing, depending on the direction of movement. Hydraulic chambers can also be used in combination with the spring activation means in principally the same way as when combining the drilling fluid flow method with the spring activation. In one embodiment the hydraulic chamber will upon activation be used to lift the inner tubing to convert the apparatus from coring mode to drilling mode. Subsequently, a spring is used to lower the inner tubing and convert the apparatus from drilling mode to coring mode. In another embodiment, the hydraulic chamber is used to lower the inner tubing, whereas the spring may subsequently be used to lift the inner tubing. Further to the above, it the drilling fluid flow method, the hydraulic chamber mechanism, and springs, can also be combined and utilized in any combination to either lift or lower the inner tubing multiple times.

Finally, the downhole electrical activation mechanism may be used to shift an electrically operated valve to direct portions of the drilling fluid flow to apply hydraulic pressure on pistons that either lift or lower the inner tubing. The downhole electrical activation mechanism may be used multiple times, and in combination with any other method. For instance, instead of using a shear pin that is sheared by applying weight from surface or excessive drilling fluid flow rate, this may be an electrically operated shear pin.

Each of said activation and lifting methods will now be further explained in view of the drawings.

Figure 3:
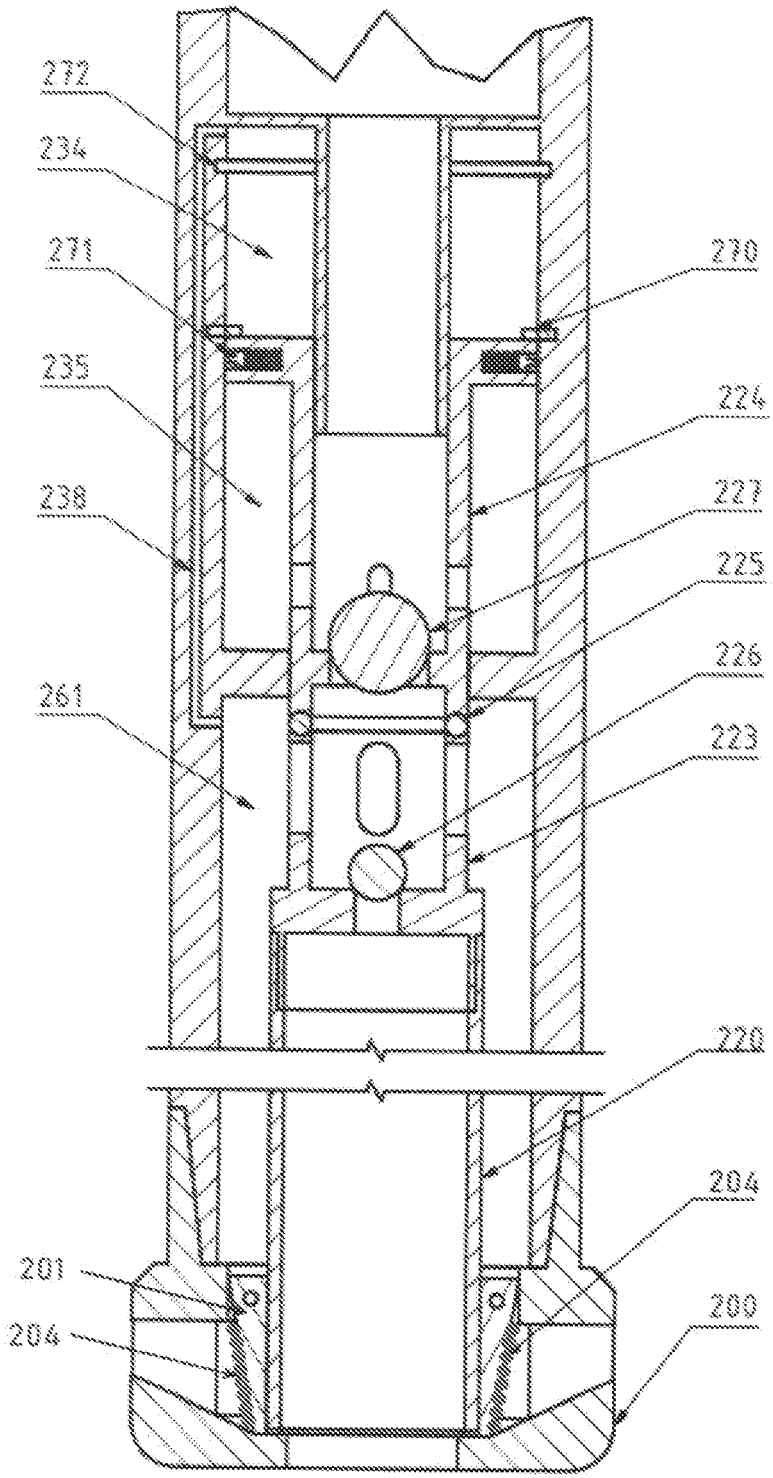
FIG. 3 illustrates an embodiment of the core drilling apparatus in coring mode with a ball as an activation device and where internal circulation of drilling fluid is used to provide force to the lifting device.

FIG. 3 illustrates one embodiment of the core drilling apparatus in coring mode with a ball 227 as an activation device and where internal circulation of drilling fluid is used to provide force to the lifting device. The apparatus is ready to be activated and converted to drilling mode, with the inner tubing 220 extended all the way down to very close proximity to bit face of the coring drill head 200. The internal closure elements 201, comprising integrated cutting implements 204, in the coring drill head 200 are pushed to the side into recesses. Attached to the end of the inner tubing 220, distal to the coring drill head 200, is the lower bearing assembly 223 with the ball seat for the drop ball 226. The ball 226 is dropped from the start of the coring operation and forces flow into the internal annulus 261. The bearing 225 allows the lower bearing assembly 223 to spin against the upper bearing assembly 224, to allow the rock core sample to enter the inner tubing 220 with a minimum of rotational forces. To initiate the transition from coring to drilling mode, a bigger ball 227 is dropped. As the ball 227 rests in the ball seat, the flow of drilling fluid will be diverted and the pressure in the lower chamber 235 increases. The resulting force acting upwards in the chamber will break the shear pins 270, which previously prevented the inner barrel from unintentionally moving upward. Any fluid located in the upper chamber 234 can escape through a flow channel 238 to internal annulus 261 of the apparatus. When the bearing assembly with inner barrel 220 has reached its upper position, spring forced shear pins 271 will lock into a recess 272 and prevent the inner barrel 220 from sliding down and return to its initial position.

Figure 4:
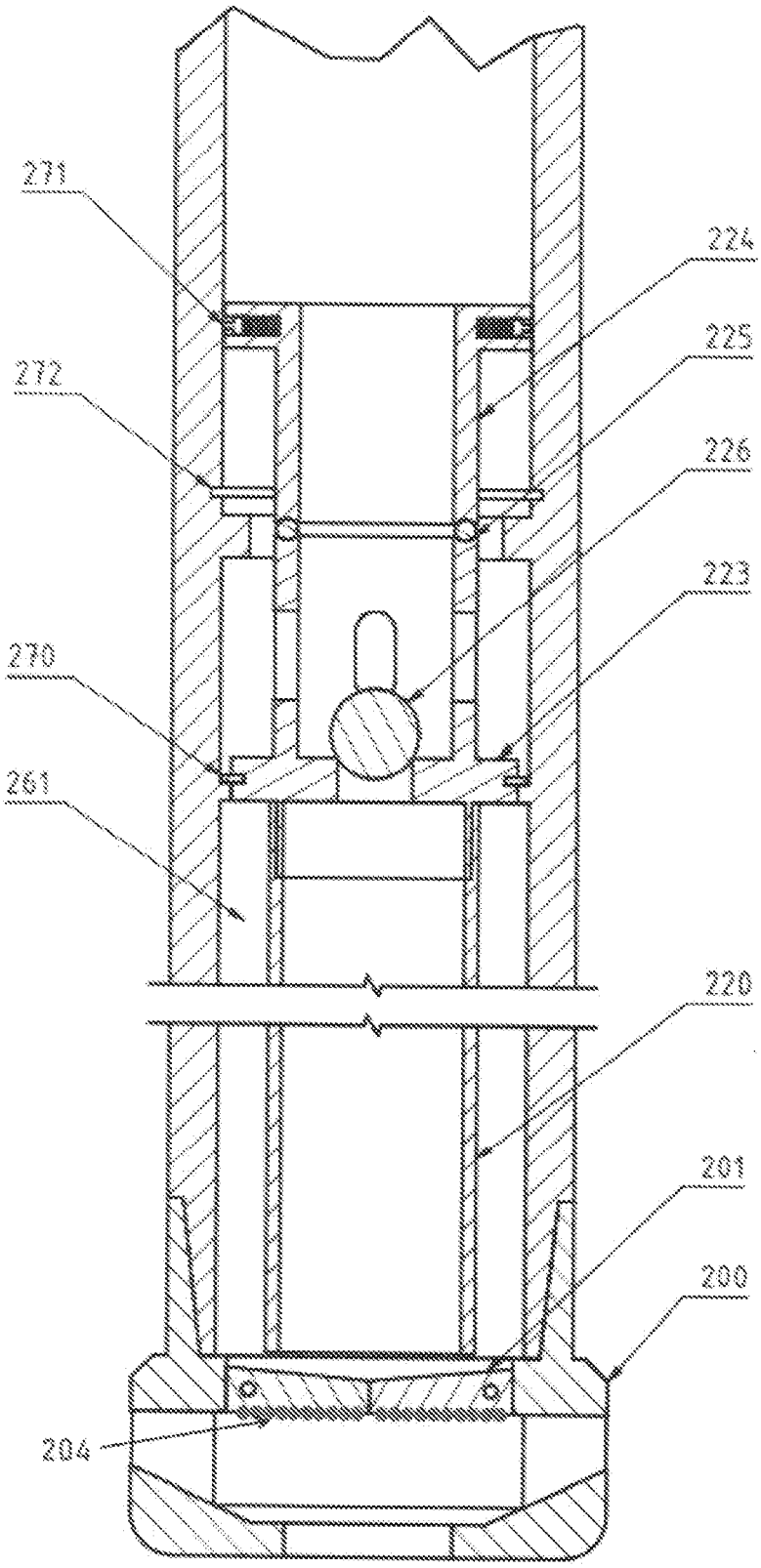
FIG. 4 illustrates an embodiment of the core drilling apparatus in drilling mode with a ball as an activation device and where internal circulation of drilling fluid is used to provide force to the lifting device.

FIG. 4 illustrates an embodiment of the core drilling apparatus in drilling mode with a ball as an activation device and where internal circulation of drilling fluid is used to provide force to the lifting device. In drilling mode, the inner barrel 220 of the apparatus is retracted to a position above the coring drill head 200. The internal closure elements 201 in the coring drill head 200 have been released from their recess position and are closed across the center opening of the coring drill head 200. To convert the core drilling apparatus from drilling to coring mode, a ball 226 is dropped from surface to land in the ball seat of the lower bearing assembly 223. As the internal flow of drilling fluid is blocked, the circulation pressure increases and the shear pins 270 will eventually break. The bearing assembly 223, 224 with inner barrel 220 will then be pushed down. As the bearing assembly is pushed down, a connection opens between the lower bearing assembly 223 and the internal annulus 261, allowing the flow of drilling fluid to divert into internal annulus 261 the core drilling apparatus. Although the force of the drilling fluid flow acting downwards will decrease, the combined hydraulic pressure and gravity will continue to push the inner tubing 220 further down. When the lower bearing assembly 223 has reached the lowermost position, spring loaded shear pins 271 will lock into a recess 272 and prevent the inner tubing 220 from being pushed back up.

Figure 5:
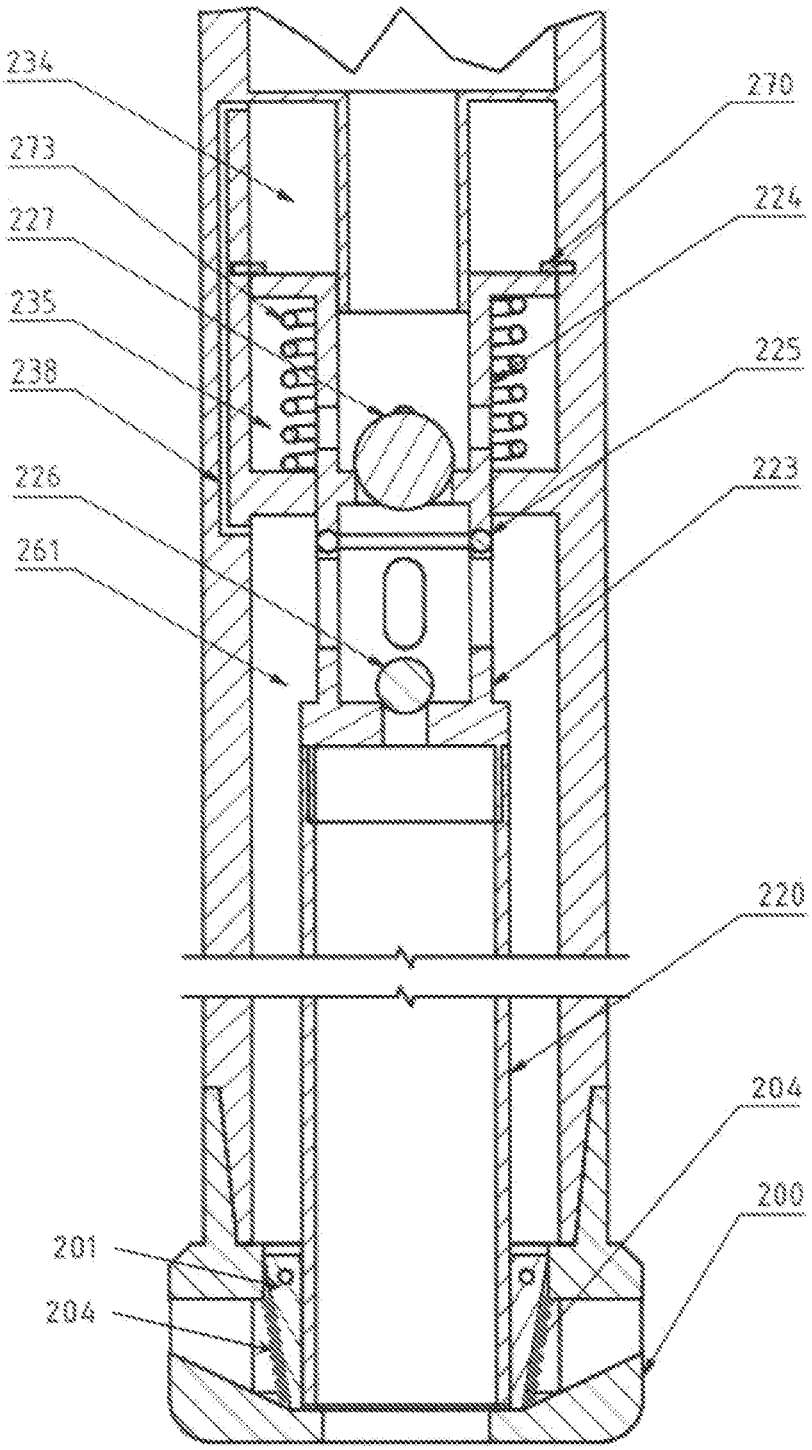
FIG. 5 illustrates an embodiment of the core drilling apparatus in coring mode with a ball as an activation device and with a spring is used to provide force to the lifting device.

FIG. 5 illustrates an embodiment of the core drilling apparatus in coring mode with a ball as an activation device and with a spring is used to provide force to the lifting device. The apparatus is ready to perform a transition from coring to drilling mode, with the inner barrel 220 pushed all the way down to proximity of the bit face of the coring drill head 200. The internal closure elements 201 in the coring drill head 200 are pushed to the side into recesses. Attached to the end of the inner tubing 220, distal to the coring drill head 200, is the lower bearing assembly 223 with the ball seat for the drop ball 226. The ball 226 is dropped for the start of the coring operation and forces flow into the internal annulus 261. The bearing 225 allows the lower bearing assembly 223 to spin against the upper bearing assembly 224, to allow the rock core sample to enter the inner tubing 220 with a minimum of rotational forces. To initiate the transition from coring to drilling mode, a bigger ball 227 is dropped. As the ball 227 rests in the ball seat, the pressure in the lower chamber 235 increases. The resulting pressure force acting upwards combined with the force of the compressed spring 273 will break the shear pins 270, which previously prevented the inner barrel from unintentionally moving upward. As the shear pins 270 break, the force of the compressed spring will be released and lift the upper bearing assembly 224 with the inner tubing 220, thus allowing the closure elements 201 to close the center opening of the coring drill head 200. Any fluid in the upper chamber 234 can escape through a flow channel 238 to the internal annulus 261 of the apparatus. The retaining force of the spring 273 will prevent the inner barrel from moving back down and return to its original position.

Figure 6A:
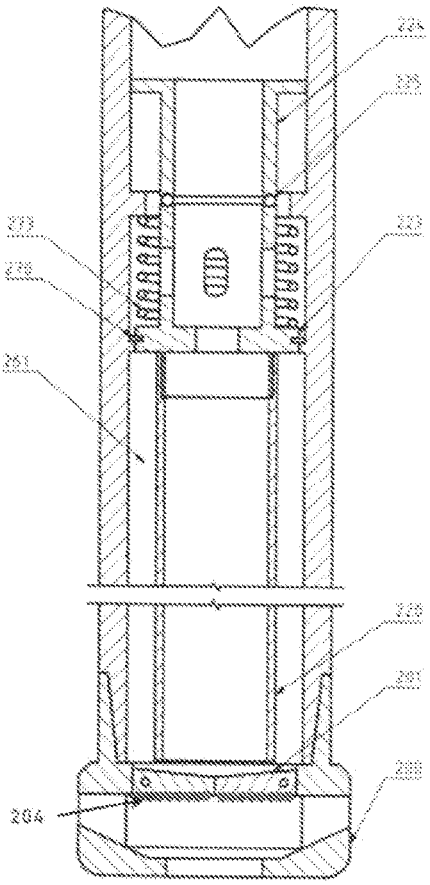
FIG. 6 illustrates a transition from drilling mode to coring mode of the core drilling apparatus, and where a spring is used to provide force to the lifting device and a ball is used as an activation device.
Figure 6B:
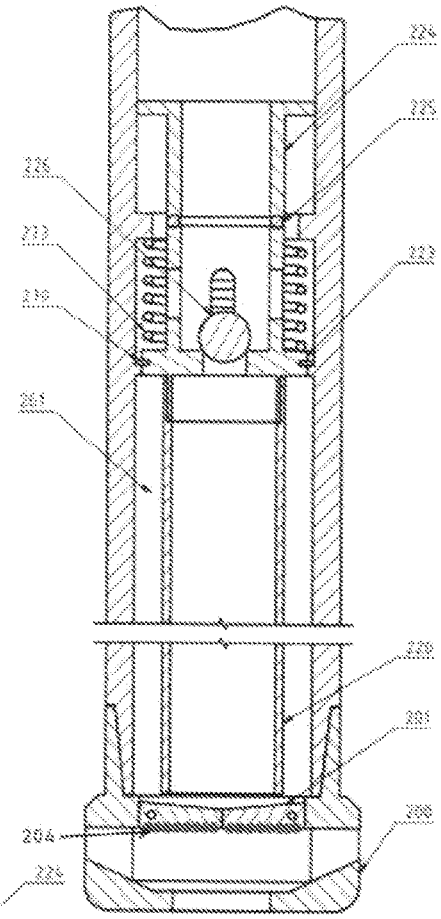
Figure 6C:
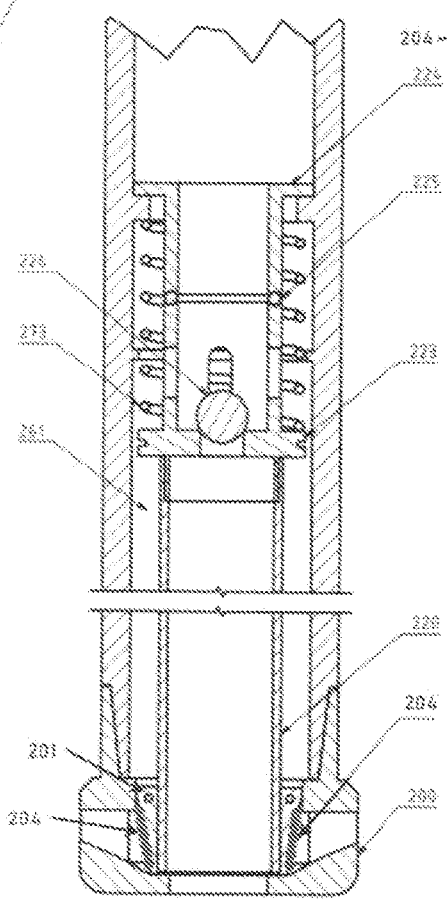

FIG. 6 illustrates transition from drilling mode to coring mode of the core drilling apparatus, and where a spring is used to provide force to the lifting device and a ball is used as an activation device. The figure shows three different phases when performing a transition from drilling to coring mode. To the left, the tool is shown in drilling mode. The inner tubing 220 is retracted to above the coring drill head 200 and the internal closure elements 201 are extended and closed across the center opening of the coring drill head 200. Shear pins 270 prevent the inner tubing 220 from sliding down toward the closure elements 201. In the illustration in the middle, a ball 226 is dropped from surface to land in the ball seat of the lower bearing assembly 223. As the internal flow of drilling fluid is blocked by the ball 226 in the ball seat, the pressure increases and the shear pins 270 will break due to the combined hydraulic pressure and the force of the compressed spring 273. In the illustration to the right, the shear pins 270 have been broken, the force of the compressed spring has been released and has pushed the lower bearing assembly 223 downward, aligning with openings that allow the internal drilling fluid flow to be diverted into the internal annulus 261 of the apparatus. The inner tubing 220 will open the internal closure elements 201 of the coring drill head 200 while moving down, eventually coming to rest in close proximity to the bit face of the coring drill head, thus allowing a rock core sample to enter the inner tubing 220, consistent with a coring mode of operation.

Figure 7:
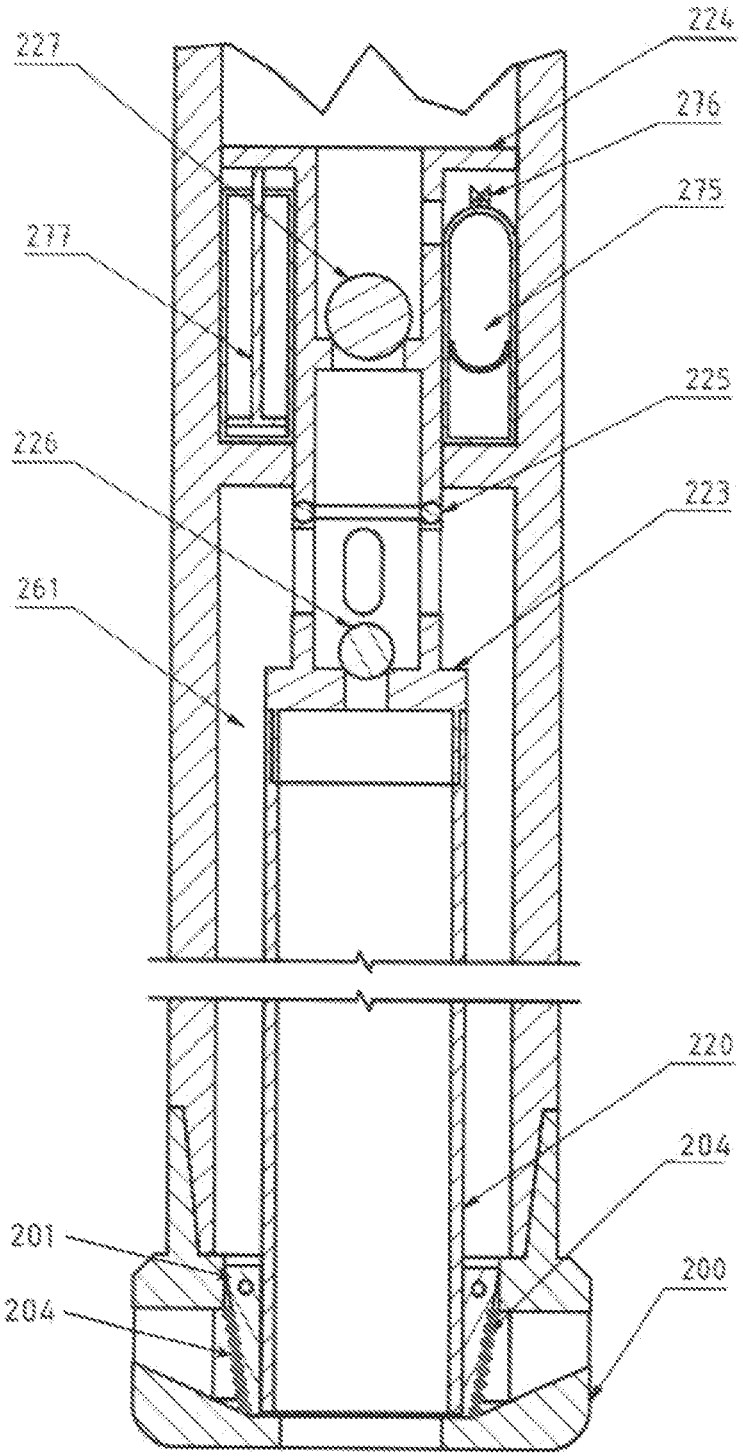
FIG. 7 illustrates an embodiment of the core drilling apparatus in coring mode with a ball as an activation device and where hydraulic chambers and a piston are used to provide force to the lifting device.

FIG. 7 illustrates an embodiment of the core drilling apparatus in coring mode with a ball as an activation device and where hydraulic chambers and a piston are used to provide force to the lifting device. The core drilling apparatus is ready to perform transition from coring to drilling mode, with the inner barrel 220 pushed all the way down to close proximity to the bit face of the coring drill head 200. The internal closure elements 201 in the coring drill head 200 are pushed to the side into recesses, and the center opening of the coring drill head 200 is open to allow a rock core sample to enter the inner tubing 220. A small ball 226 has been dropped to land in the ball seat of the lower bearing assembly 223, to divert the internal flow of drilling fluid from inside the inner tubing 220 to the internal annulus 261 between the inner and outer tubing. To convert the core drilling apparatus to drilling mode, a second, larger ball 227 has been dropped to land in the ball seat of the upper bearing assembly 224. As the internal flow of drilling fluid is now blocked, the hydraulic pressure increases and breaks a disc in a valve 276. Hence, the hydraulic fluid may flow out of the pre-charged hydraulic chamber 275 and will flow to a piston 277, which will lift the bearing assembly 223, 224 with the inner tubing 220. As the lowermost end of the inner tubing 220 retracts behind the coring drill head 200, the closure elements 201 will close the center opening of the coring drill head 200, and the apparatus will be ready for full-diameter drilling.

Figure 8:
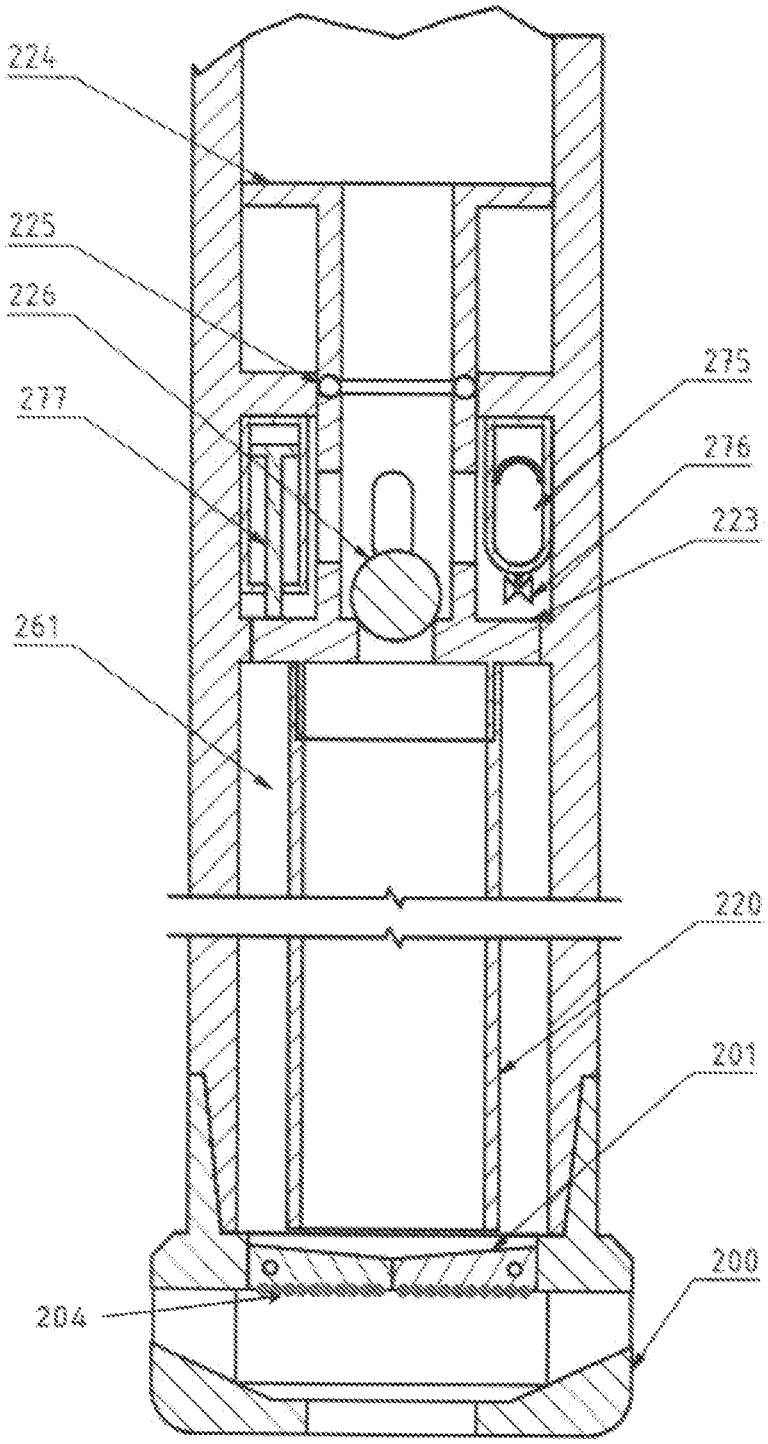
FIG. 8 illustrates an embodiment of the core drilling apparatus in drilling mode with a ball as an activation device and where hydraulic chambers and a piston are used to provide force to the lifting device.

FIG. 8 illustrates an embodiment of the core drilling apparatus in drilling mode with a ball as an activation device and where hydraulic chambers and a piston are used to provide force to the lifting device. The core drilling apparatus is ready to perform a transition from drilling to coring mode. The inner tubing 220 is prevented from travelling along the axis of the apparatus by a piston 277 in its extended position. A ball 226 has been dropped from the surface and blocks the internal flow of drilling fluid. As the hydraulic pressure from the drilling fluid increases, a disc in the valve 276 will break. Hence, fluid may flow out of the pre-charged hydraulic chamber 275 to the piston 277, which will retract and lower the bearing assemblies 223, 224 and subsequently the inner tubing 220 down to the bit face. The inner tubing 220 will open the internal closure elements 201 of the coring drill head 200 while going down, eventually coming to rest in close proximity to the bit face of the coring drill head, thus allowing a rock core sample to enter the inner tubing 220.

Figure 9:
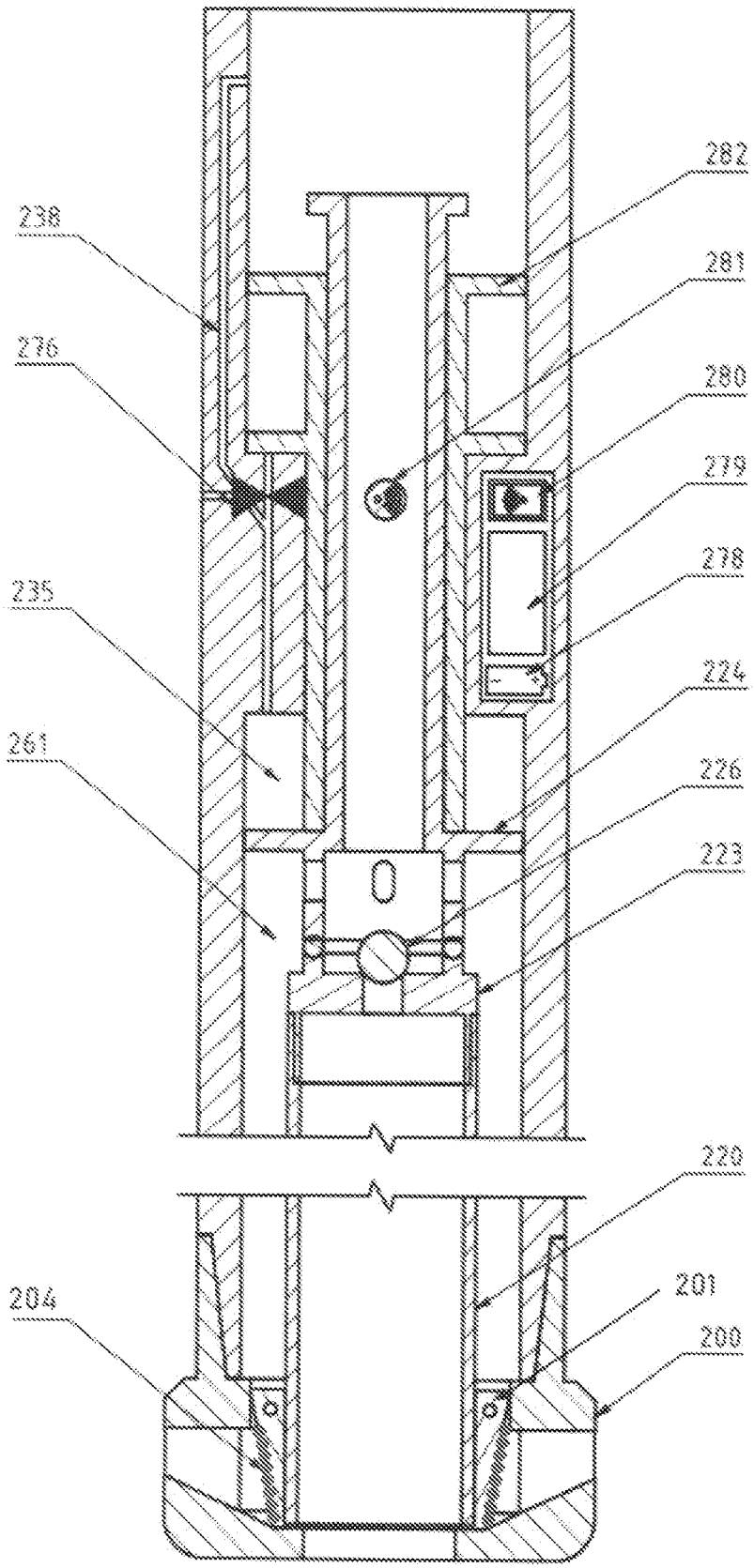
FIG. 9 illustrates an embodiment of the core drilling apparatus in coring mode with a flowable device as an activation device for a battery powered electrical valve, and where internal circulation of drilling fluid is used to provide force to the lifting device.

FIG. 9 illustrates an embodiment of the core drilling apparatus in coring mode with a flowable device as an activation device for a battery powered electrical valve, and where internal circulation of drilling fluid is used to provide force to the lifting device. In this configuration, the initiation of the activation process is done by dropping the flowable device from surface. The flowable device carries a message or command which is continuously transmitted from the device. When the flowable device passes a receiver unit within the downhole tool, the message is picked up by the receiver unit and a corresponding action is initiated.

The core drilling apparatus is illustrated in coring mode, just before being activated for drilling, with the inner tubing 220 extended all the way down to be in close proximity to bit face of the coring drill head 200. The internal closure elements 201 in the coring drill head 200 are pushed to the side into recesses. Attached to the end of the inner tubing 220, distal to the coring drill head 200, is the lower bearing assembly 223 with a ball seat for a drop ball 226. The ball 226 was dropped to initiate the coring operation and forces flow into the internal annulus 261.

To initiate a transition to drilling mode, a flowable device 281 is dropped from surface. As the flowable device 281 passes the receiver unit 280, the electronics unit 279 powered by the battery 278 or other power means will upon receipt of the message from the flowable device 281 initiate an activation of the electrically operated hydraulic valve 276 to allow the flow of drilling fluid to be diverted and the pressure in the upper chamber 234 increases. The upper chamber 234 is visible on FIG. 10 described below. Any fluid located in the lower chamber 235 can escape through a flow channel 238 to the internal annulus 261 of the apparatus. When all the fluid located in the lower chamber 235 has evacuated and the bearing assembly 224 with inner barrel 220 has reached its upper position, corresponding to the top of the hydraulic lift system 282 reaching the upper part of the upper bearing assembly 224, the electrically operated hydraulic valve 276 is activated and switched again to prevent any fluid located in the upper chamber 234 from evacuating, thus preventing the inner barrel 220 from sliding down and return to its initial position.

As an additional means of operation, the receiver unit 280 may also be configured to transmit data back to and, exchange information with, the flowable device 281. Such data may include confirmation that the initial command was received, and other data such as downhole sensor information, electronics status information and operating parameter information. The flowable device may subsequently be circulated down through the internal annulus 261, through the lower sections of the core drilling apparatus and circulated back to the surface, as is well known in the art, whereby the flowable device 281 is collected and the information contained therein retrieved by the means of a surface reading unit.

Figure 10:
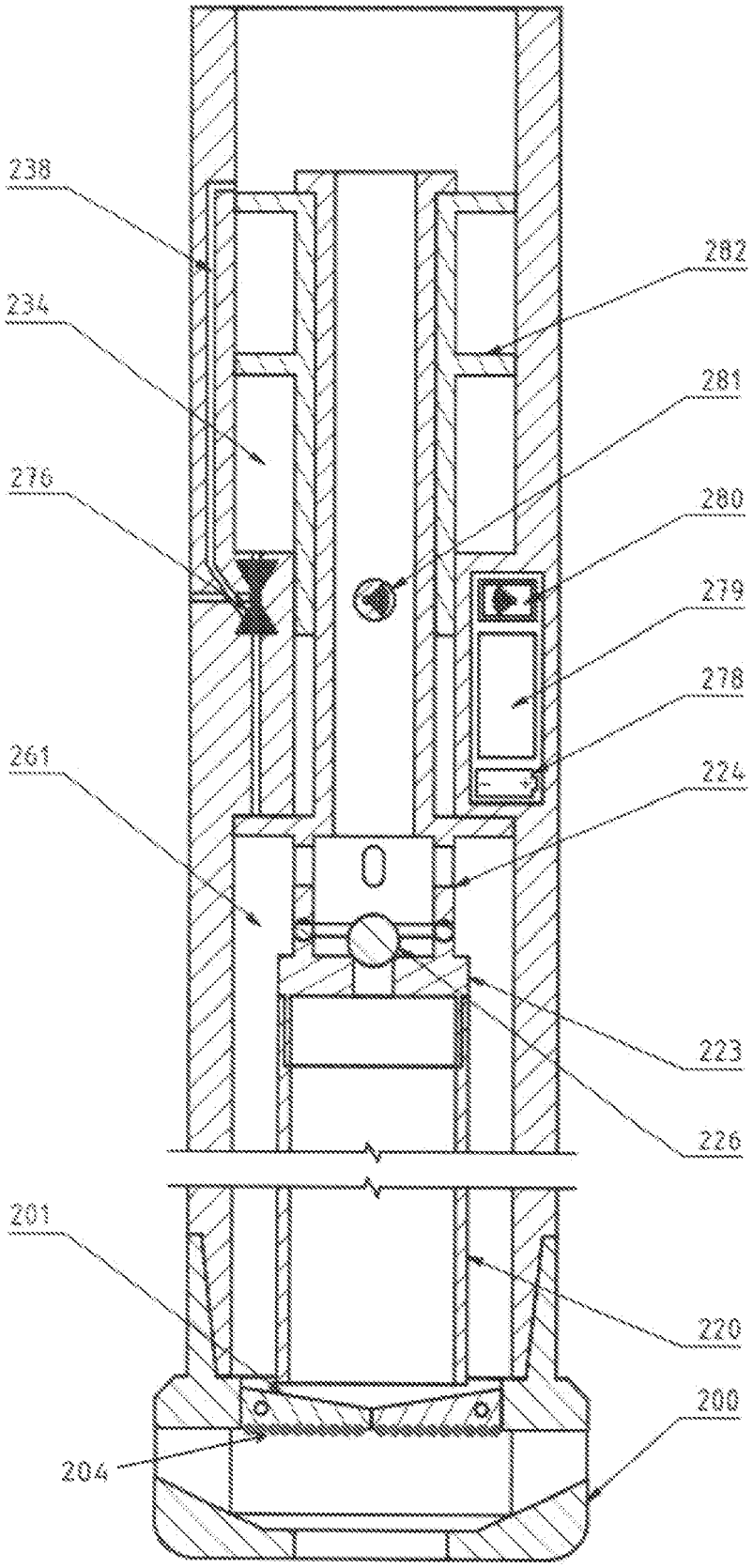
FIG. 10 illustrates an embodiment of the core drilling apparatus in drilling mode with a flowable device as an activation device for a battery powered electrical valve, and where internal circulation of drilling fluid is used to provide force to the lifting device.

FIG. 10 illustrates an embodiment of the core drilling apparatus in drilling mode with a flowable device as an activation device for a battery powered electrical valve, and where internal circulation of drilling fluid is used to provide force to the lifting device. In drilling mode, the inner barrel 220 is retracted to a position above the coring drill head 200. The internal closure elements 201 in the coring drill head 200 have been released from their recess position and are closed across the center opening of the coring drill head 200. Attached to the end of the inner tubing 220, distal to the coring drill head 200, is the lower bearing assembly 223 with the ball seat for the drop ball 226. The ball 226 is dropped to initiate the coring operation and forces flow into the internal annulus 261.

To initiate a transition of the core drilling apparatus from drilling mode to coring mode, a flowable device 281 is dropped from surface. As the flowable device 281 passes the receiver unit 280, the electronics unit 279 powered by the battery 278 or other power means will upon receipt of the message from the flowable device 281 initiate an activation of the electrically operated hydraulic valve 276 to allow the flow of drilling fluid to be diverted and the pressure in the lower chamber 235 increases. The lower chamber 235 is visible on FIG. 9. Any fluid located in the upper chamber 234 can escape through a flow channel 238 to the internal annulus 261 of the apparatus. When all the fluid located in the upper chamber 234 has evacuated and the bearing assembly 224 with inner barrel 220 has reached its lower position, corresponding to the bottom of the hydraulic lift system 282 reaching the lower part of the upper bearing assembly 224, the electrically operated hydraulic valve 276 is activated and switched again to prevent any fluid located in the lower chamber 235 from evacuating, thus preventing the inner barrel 220 from being forced up by the friction from the core sample entering the inner barrel 220. As mentioned above, the receiver unit 280 may also be configured to transmit data back to and, exchange information with, the flowable device 281.

The present invention provides a flexible core drilling apparatus that can be converted to operate in coring mode or in drilling mode and where transition between the modes is activated and driven by mechanical and/or hydraulic means.

The invention claimed is:

1. A core drilling apparatus adapted to be converted between a core drilling assembly and a full-diameter drilling assembly, comprising a coring drill head, an outer tubing for conveying forces to the drill head, an inner tubing with an upper end connected to a lifting device and a lower end adapted for receiving a core sample, a conveyance arrangement connected to the upper end of the outer tubing for providing movement of the core drilling assembly within a borehole, and where the lifting device is adapted to run between an upper and lower position within the outer tubing, wherein:

the coring drill head comprises closure elements with integrated cutting implements that when in a closed or partly closed position enable the drilling head to operate with full diameter drilling and with the closure elements in an open position enable the drilling head to operate as a coring drill head by letting rock sample pass into the inner tubing the lifting device comprises a release mechanism that when activated, releases forces acting on the lifting device such that when the lifting device is in an upper position when activated, the lifting device lowers the inner tubing thereby pushing the closure elements in an open position, and when the lifting device is in a lower position when activated, the lifting device lifts the inner tubing from the closure elements such that the closure elements will be in a closed or partly closed position.

2. The core drilling apparatus according to claim 1, comprising flow channels connecting the lifting device to drilling fluid flow, where the flow channels are opened when the release mechanism is activated thereby letting pressure forces exerted from circulation of drilling fluid in the flow channels act on the lifting device for lifting or lowering it.

3. The core drilling apparatus according to claim 1, comprising one or more pre-charged hydraulic chambers connected to the lifting device where fluid flow is released from the hydraulic chamber(s) when the release mechanism is activated, thereby letting pressure forces exerted from the fluid flow act on the lifting device for lifting or lowering it.

4. The core drilling apparatus according to claim 1, comprising one or more compressed springs connected to the lifting device where mechanical forces are released from the spring(s) when the release mechanism is activated, thereby letting pressure forces exerted from the spring(s) act on the lifting device for lifting or lowering it.

5. A method for converting a core drilling apparatus between a core drilling assembly and a full-diameter drilling assembly, the core drilling assembly comprising a coring drill head, an outer tubing for conveying forces to the drill head, an inner tubing with an upper end connected to a lifting device and a lower end adapted to receiving a core sample, conveyance arrangement connected to the upper end of the outer tubing for providing movement of the core drilling assembly within a borehole, and where the lifting device is adapted to run between an upper and lower position within the outer tubing wherein:

running the core drilling apparatus into a wellbore, where the coring drill head comprises closure elements with integrated cutting implements that when in a closed or partly closed position enable the drilling head to operate with full diameter drilling and with the closure elements in an open position enable the drilling head to operate as a coring drill head by letting rock sample pass into the inner tubing;

activating a release mechanism comprised in the lifting device thereby releasing forces acting on the lifting device, such that when the lifting device is in an upper position when activated, the lifting device lowers the inner tubing thereby pushing the closure elements in an open position to enable coring mode, and when the lifting device is in a lower position when activated, the lifting device lifts the inner tubing from the closure elements such that the closure elements will be in a closed or partly closed position to enable drilling mode.

6. The method according to claim 5, by releasing forces acting on the lifting device, when the release mechanism is activated, by opening flow channels connecting the lifting device to drilling fluid flow, thereby letting pressure forces exerted from circulation of drilling fluid in the flow channels act on the lifting device for lifting or lowering it.

7. The method according to claim 5, by releasing forces acting on the lifting device, when the release mechanism is activated, by releasing fluid flow from one or more pre-charged hydraulic chambers connected to the lifting device, thereby letting pressure forces exerted from the fluid flow act on the lifting device for lifting or lowering it.

8. The method according to claim 5, by releasing forces acting on the lifting device, when the release mechanism is activated, by releasing one or more compressed spring(s) connected to the lifting device, thereby letting mechanical forces exerted from the spring(s) act on the lifting device for lifting or lowering it.

9. The core drilling apparatus according to one of the claims 2, 3 or 4, where the release mechanism comprises a ball seat for receiving a ball that when dropped activates the release mechanism.

10. The core drilling apparatus according to one of the claims 2, 3 or 4, where the release mechanism comprises a shear pin that when applied mechanical force brakes and activates the release mechanism.

11. The core drilling apparatus according to one of the claims 2, 3 or 4, where the release mechanism comprises a disc that when applied hydraulic force brakes and activates the release mechanism.

12. The core drilling apparatus according to one of the claims 2, 3 or 4, where the release mechanism comprises an electronic receiving unit adapted to control an electrical valve comprised in the core drilling assembly when receiving signals from a dropped flowable device.

13. The method according to one of the claims 6, 7 or 8, where the release mechanism is activated by dropping a ball onto a ball seat comprised in the release mechanism.

14. The method according to one of the claims 6, 7 or 8, where the release mechanism is activated by breaking a disc comprised in the release mechanism.

15. The method according to one of the claims 6, 7 or 8, where the release mechanism is activated by breaking a shear pin comprised in the release mechanism.

16. The method according to one of the claims 6, 7 or 8, where the release mechanism is activated by letting a flowable device trigger an electronic receiving unit when detecting the flowable device, where the electronic receiving unit is adapted to control an electrical valve comprised in the core drilling assembly.

* * * * *